US005317825A

United States Patent [19]

Vatterott et al.

[11] Patent Number: 5,317,825

[45] Date of Patent: Jun. 7, 1994

[54] CHOKE ASSEMBLY FOR A SHOTGUN

[75] Inventors: Oskar F. Vatterott, Franklin, Mo.; Robert K. Scott, Brown, Ind.

[73] Assignee: C.G.I. Corporation, Vincennes, Ind.

[21] Appl. No.: 29,761

[22] Filed: Mar. 11, 1993

[51] Int. Cl.[5] ..... F41H 21/40

[52] U.S. Cl. ..... 42/79; 89/14.3

[58] Field of Search ..... 42/79; 89/14.2, 14.3, 89/14.4

[56] References Cited

U.S. PATENT DOCUMENTS

| | | | |
|---|---|---|---|
| Re. 20,958 | 12/1938 | White | 42/79 |
| 847,911 | 3/1907 | Cory | 42/79 |
| 1,598,360 | 8/1926 | Pavek | 42/79 |
| 2,567,826 | 9/1951 | Prache | 89/14.3 |
| 3,492,750 | 2/1970 | Ashbrook et al. | 42/79 |
| 5,157,211 | 10/1992 | Mossberg | 42/79 |

*Primary Examiner*—David H. Brown

*Attorney, Agent, or Firm*—Polster, Lieder, Woodruff & Lucchesi

[57] ABSTRACT

A choke assembly (10) is attachable to the muzzle end of a shotgun barrel (G) to produce a tightened shot pattern when the shotgun is fired. A shotgun shell includes shot (S) and a wading (W). The wading is spun through the barrel by discharge gases created when the shell is fired, and this spinning motion tends to increase the size of the shot pattern. The choke comprises an elongate hollow tube (12) having an inner end (14) receivable in the muzzle end (M) of the barrel. An inner diameter (D1) of the tube corresponds to that of the barrel at its muzzle end. An outer end (24) of the tube extends beyond the muzzle. The inner diameter of the tube decreases from the inner to the outer end of the tube to effect a choke. The outer end of the tube also has a plurality of longitudinally extending slots (28) formed therein, these being spaced circumferentially about the tube. Discharge gases propelling the wading through the barrel tends to force the wading radially outwardly through the slots. This slows the wading and stops its spinning which, in turn, increases the tightness of the shot pattern. Further, a portion of the discharge gases are also expelled radially outwardly through the slots which reduces the recoil of the shotgun.

21 Claims, 5 Drawing Sheets

CHOKE ASSEMBLY FOR A SHOTGUN

BACKGROUND OF THE INVENTION

This invention relates to shotguns and, more particularly, to a choke and recoil reducer which both tightens the shot pattern of a shell fired by the shotgun, slows down the wad propelled down the shotgun barrel with the shot, and simultaneously reduces the recoil force associated with firing the weapon.

The use of choke devices to tighten the shot pattern for a charge fired by a shotgun is well-known. In the past, chokes were separate elements which had to be permanently attached to the muzzle end of a shotgun barrel. To do this, the owner had to send his shotgun to a gunsmith or the the like who either fitted a choke to the existing barrel; or, replaced the barrel with a new one having the choke attached. More recently, shotguns have been provided with a barrel whose muzzle has interior threads. This allows an appropriately made choke to be threaded onto the end of the barrel. The importance of this is that it allows the owner to interchange chokes so he can use one when hunting quail, for example, and a different one for hunting doves.

There are still, however, problems in obtaining as tight a shot pattern as may be desirable for hunting a particular bird or game. For example, a shotgun shell includes both a quantity of shot; i.e., pellets of a given size. It also includes a wadding in which the shot is encased. When the shotgun is fired, the wadding is propelled through the barrel along with the shot. In fact, the shot is carried by the wadding until both are projected from the muzzle end of the shotgun. The wadding may, for example, be thrown 40–50 yards from the shotgun. The wadding spins as it moves through the barrel creating a centrifugal force imparted to the shot. When the shot is ejected from the barrel, it is has both a forward and a sideways force imparted to it. This results in a spread of shot greater than desired. Conventional choke designs do little or nothing to reduce this phenomenon. It is also desirable to reduce the recoil force produced when the shotgun is fired. As with chokes, there are various types of recoil reducers known in the art. Also as with chokes, these devices are attached to the muzzle end of the shotgun with the purpose of redirecting the gases away from the normal direction directly out from the muzzle. In an effort to effect a choke and recoil, some prior devices have been designed to incorporate both functions. However, these devices are relatively ineffective to achieve both desired results, and none resolves the problem created by the wading as described above.

SUMMARY OF THE INVENTION

Among the several objects of the present invention may be noted the provision of a choke assembly for use on a shotgun to effect a reduction in the dispersion pattern of shot fired from the shotgun; the provision of such a choke assembly which is readily installed on, and removed from, the muzzle end of a shotgun barrel using a simple tool; the provision of such a choke assembly to not be dislodged when steel shot is used in the shotgun; the provision of such a choke assembly to be available in different sizes for use on many different types of shotguns; the provision of such a choke assembly to effectively slow down or stop the spinning of a wadding traveling through the choke thereby to further enhance the choking action produced; the provision of such a choke assembly which also effects a reduction in the recoil of the shotgun; the provision of such a choke assembly to include a recoil reduction attachment which serves to further reduce the recoil force of the shotgun; the provision of such a choke assembly which is self-cleaning; and, the provision of such a choke assembly which is sturdy, portable, readily installed and removed in the field, and easily stored.

In accordance with the invention, generally stated, a choke assembly is attachable to the muzzle end of a shotgun barrel to produce a tightened shot pattern when the shotgun is fired. A shotgun shell includes both shot and a wadding which carries the shot through the barrel. The wadding spins through the barrel, this spinning action being caused by the swirling discharge gases created when the shell is fired. This spinning motion tends to increase the size of the shot pattern. The choke comprises an elongate hollow tube having an inner end receivable in the muzzle end of the barrel. An inner diameter of the tube corresponds to that of the barrel. An outer end of the tube extends beyond the muzzle. The inner diameter of the tube decreases from the inner to the outer end of the tube to effect a choke. The outer end of the tube also has a plurality of longitudinally extending slots formed in it, these being spaced circumferentially about the tube. Discharge gases propelling the wadding through the barrel force the wadding radially outwardly through the slots. This outward movement of the wadding causes it to be cut into by the outer ends of the slots. This, in turn, slows the wading and stops its spinning. The result is an increase in the tightness of the shot pattern. Further, a portion of the discharge gases are also expelled radially outwardly through the slots which reduces the recoil of the shotgun. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF PREFERRED EMBODIMENTS

Figure 1:
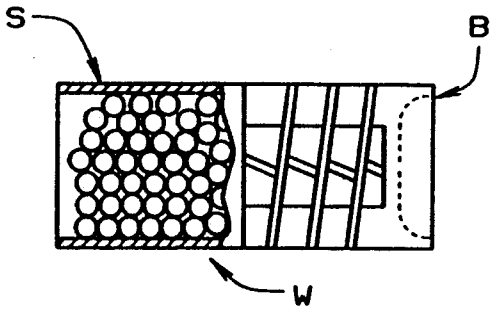
FIG. 1 is a sectional view of the wadding and shot of a shotgun shell.
Figure 2A:
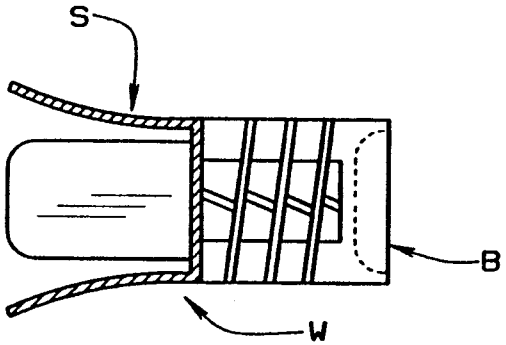
FIG. 2A is a sectional view of the wadding after the shell has been fired.

Referring to the drawings, FIG. 1 illustrates a portion of a conventional shell fired from a shotgun. As shown in FIG. 1, the shell includes a wadding W having a collapsible base B and an upstanding circumferential sidewall C. Shot S is carried by the wadding, the shot being pellets of steel or lead. As is well-known, the shot may be of different sizes depending upon the type of game being hunted. Further, though not shown in FIG. 1, sidewall S may have longitudinally extending slits, or other design features to facilitate separation of the shot from the wadding when the shell is fired. When a shell is fired, both the wadding and the shot are propelled through the shotgun barrel For example, it is not uncommon for the wadding to be thrown forty (40) or more yards from the end of the gun. As seen in FIG. 2, the discharged wadding exhibits both the collapsed base and a sidewall which has been ripped into sections. Wadding W is typically made of a plastic material, while shot S which used to be primarily lead shot is now more commonly a steel shot.

It is well-known that wadding spins as it moves through the shotgun barrel. This twisting motion creates a centrifugal force which is transmitted to at least some of the shot. The result is the shot, when it leaves the muzzle end of the barrel, has both forward and sideways forces imparted to it. Accordingly, in addition to the normal dispersion forces which cause the shot pellets to spatially separate when they leave the muzzle, these sideways forces accentuate, to some degree, the dispersal pattern. When hunting with a shotgun, a major factor in the hunter's success is shot dispersion. Hunters typically know that for a particular shot used to hunt a particular game, what the dispersion is. Usually, the dispersion pattern is a measure of the percentage of pellets which fall within a particular diameter circle at a certain distance (measured in yards).

Hunters have the capability of tightening, or "choking", the dispersal pattern of their shotguns This is done by installing what is commonly referred to as a choke on the muzzle end of the shotgun barrel. A choke functions by reducing the diameter of the shotgun barrel at its muzzle end. This, in turn, compacts the pellets immediately prior to their discharge. Now, as they spread out, the area which they cover is much smaller in diameter, for a given distance, than for the same weapon without a choke. Initially, the only way a hunter could install a choke was to take or send his shotgun to a gunshop where a choke was permanently affixed to end of the barrel. Later, shotguns were made with internal threads at the muzzle end. The choke then had one end correspondingly threaded so it could screwed on and off by the hunter at his convenience.

Figure 3A:
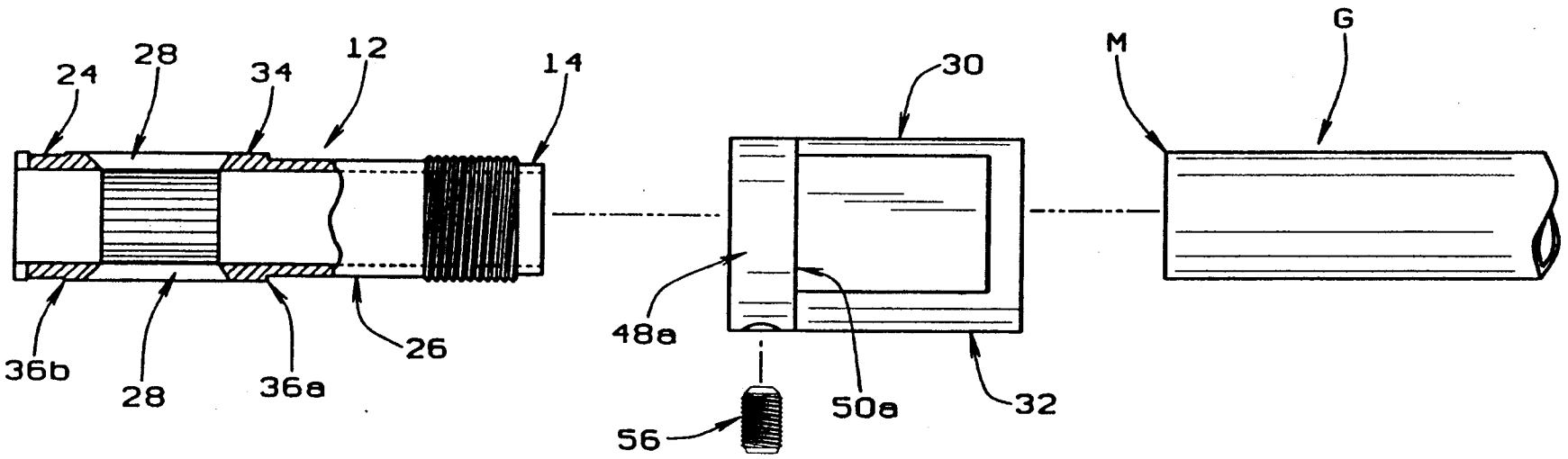
FIG. 3A is an exploded view of the assembly of the present invention.
Figure 3B:
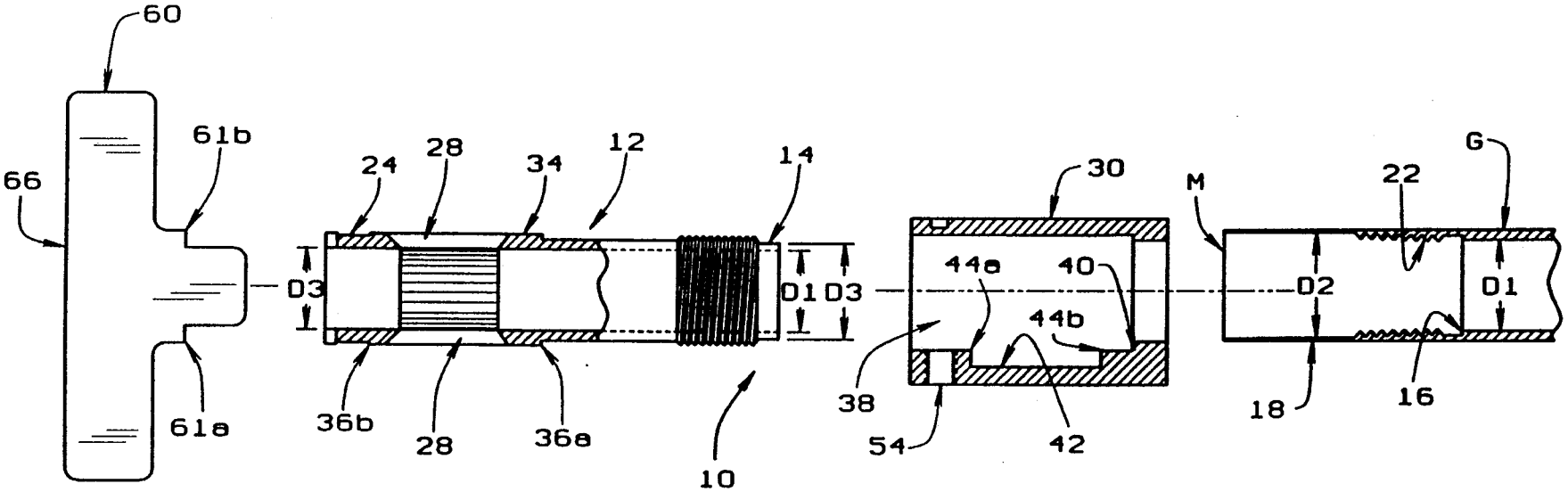
FIG. 3B is a sectional view of the components.

Referring to FIG. 3A, a choke assembly 10 of the present invention is attachable to the muzzle end M of a shotgun barrel G to produce a tightened pattern of shot when a shotgun shell is fired from the shotgun. As described above, the shotgun shell includes a plurality of shot S and a wadding W carrying the shot it is discharged down the barrel. Choke assembly 10 first includes an elongate hollow tube 12 having a threaded inner end 14 which is threadably received in the muzzle end of the barrel. The inner diameter (i.d.) D1 of tube 12 corresponds to the i.d. D1 of barrel G at its muzzle end. As particularly shown in FIG. 3B, barrel G has a circumferential shoulder 16 formed inwardly of its muzzle end. This shoulder marks a transition in the i.d. of the barrel from a smaller i.d. D1 to a larger i.d. (D2) section 18 at the muzzle end of the barrel. A length of an inner wall 20 of the barrel along section 18 is threaded, as indicated at 22. This length extends forwardly from the shoulder toward the muzzle end of the barrel. Tube 12 has an outer diameter (o.d.) D2 which corresponds to the i.d. D2 of the barrel at section 18. As noted, the i.d. of tube 12, at the inner end of the tube, corresponds to the i.d. D1 of the barrel at shoulder 16. Accordingly, when end 14 of tube 12 is threadably received in the end of the barrel, there is a smooth transition from the shotgun barrel into the inner end of the choke tube.

Figure 5:
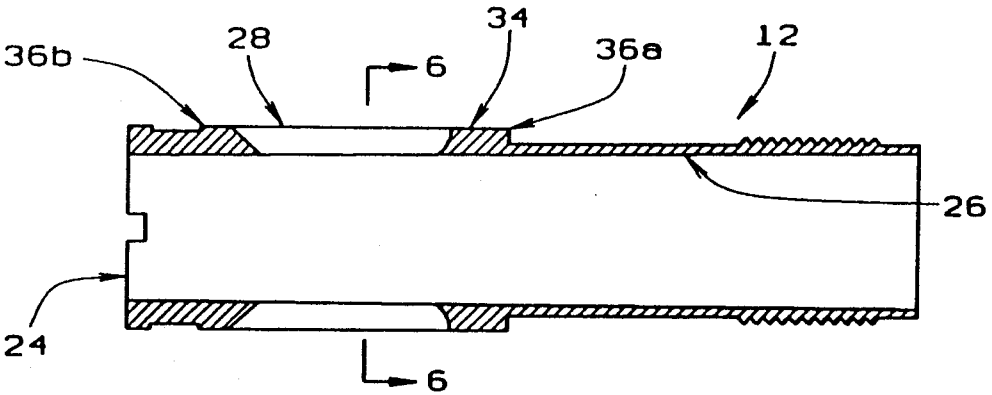
FIG. 5 is a sectional view of the choke portion of the assembly.

Tube 12 has an outer end 24 which extends beyond muzzle M. As shown in FIGS. 3A and 5, the sidewall wall 26 of tube 12 gradually thickens from the inner to the outer end of the tube. Because the o.d. of tube 12 is generally constant along the length of the tube, this gradually increase in wall thickness creates a corresponding decrease in the i.d. of the tube from its inner to its outer end; i.e. a decrease from i.d. D1 to an i.d. D3. This decrease in i.d. produces the choking effect. There can be different amounts of choking depending upon the decreases in i.d. of tube 12. Accordingly, the relative i.d. of tube 12 at its outer end, as shown in the drawings, is illustrative only.

Figure 6:
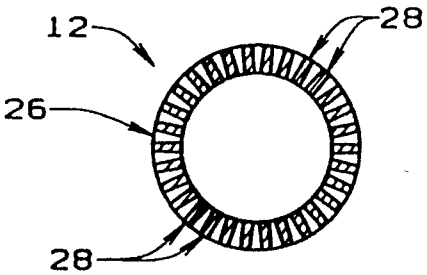
FIG. 6 is a sectional view of the choke taken along line 6—6 in FIG. 5.

It is a particular feature of choke assembly 10 that tube 12 have a plurality of slots 28 formed in the sidewall of the tube at a point intermediate the length of the tube. Slots 28 extend longitudinally of tube 12 and are spaced circumferentially about the choke tube. Referring to FIG. 6, choke tube 12 has, for example, thirty (30) slots 28 formed in sidewall 26 of the choke tube. This corresponds to a slot spacing of 12°. The importance of these longitudinal slots is that they provide escape paths, or vents, for a portion of the discharge gases propelling the wadding and shot through the barrel. Two advantages result. First, the discharging gases are pushing against the wadding, forcing it through the barrel. When the tubing reaches the choke tube, the force of the gases tends to push the tubular wall portion S of the wadding radially outwardly through the slots. The effectively slows the forward impetus of the wadding, but not the shot. Further, forcing the tubing into the slots stops its spinning. This reduces the centrifugal force imparted from the wadding to the pellets which further increases the tightness of the shot pattern. It will be understood that the presence of the longitudinal slots does not capture and hold the wadding in the choke tube because the push provided by the discharge gases is too great. However, the slowing effect produced by the slots is demonstrated by the fact that during field tests of the choke assembly, wadding was found as near as twenty (20) feet from the shotgun as opposed to the forty or so yards, as mentioned previously, wadding is typically thrown.

Figure 2B:
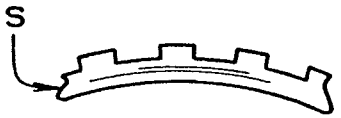
FIG. 2B is a partial end view of a sidewall of the wadding.

As noted above, gas pressure pushes the sidewall of the wading outwardly through the longitudinal slots formed in the choke tube. Further, as shown in FIG. 5, it will be noted that each end of each slot angles outwardly from the inner surface of tube sidewall 26. This angling is important because as the wadding sidewall is pushed outwardly through the slots, the forward end the sidewall S contacts the respective slopes formed by the angled ends of the slots. The forward, angled end of the slots correspondingly act as "planes" to shave off some of the plastic material forming the wadding. This effect is shown in FIG. 2B. Here, the grooves represent the shaved portions of the sidewall. The result of the slot design is to accentuate the stopping action provided by the slots to both slow down the wadding and stop its spinning through the barrel.

It will be understood that the slope angle at the ends of the slot may vary. The actual angle is determined by the overall design features required of the choke. As further evidence of the efficiency of the slots and their sloped ends, an examination of the choke, after shells have been fired during field tests, reveal "rifle like" lines, or striations, produced by the wiping action of the wad. These striations match up with the sliced away portions of the wadding sidewall.

The use of openings in chokes is known. However, in previous choke designs, the openings comprised either large holes, or slots created by ribs extending orthogonally to the longitudinal axis of the barrel and choke. These openings are used to reduce the recoil forces produced when a weapon is discharged, not to improve the operation of the choke as a choke. For example, the slots created by the ribs extend only part way around the choke.

The effect of choke assembly 10 is to greatly increase the tightness of shot dispersion. As an example, an article in *Guns & Hunting*, May, 1993, titled Patterns of Success, by Nick Sisley, Shotgun Editor, describes measuring shot dispersion patterns. As described therein, a 48"×48" target has a 30" diameter circle drawn on it. The target is fired at from 40 yards, and the number of pellets hitting inside the circle are counted. The article indicates that a good, full pattern would mean approximately 78% of the pellets landing within the circle. Further, the articles indicates that with some shotgun, choke, and load combinations, 80%–85% hits within the circle might be attainable. In field tests using the choke assembly of the present invention, pellet counts of over 90% were consistently achieved.

The second important advantage of slots 28 is that by allowing a portion of the discharge gases to be expelled radially outwardly through the slots, the shotgun's recoil is reduced. It is well understood that venting discharge gases effectively reduces the recoil forces of the shotgun. However, the present invention increases the effectiveness of this vention to further reduce recoil. In this regard, choke assembly 10 further includes a recoil reducer 30 in which choke tube 12 is installed prior to threading end 14 of the choke tube into the muzzle end of the shotgun barrel. Reducer 30 includes a hollow tube 32 sized to accommodate the choke tube. The choke tube has an increased diameter central section 34 having a circumferential shoulder 36*a*, 36*b* at each respective end. Tube 32 has central longitudinal bore 38. The forward end of the bore has an i.d. corresponding to the o.d. of choke tube section 34. A circumferential shoulder 40 is formed at the rearward end of this bore and shoulder 36*a* of choke tube section 34 abuts against this shoulder when the choke tube is inserted in the bore. The shoulder serves to decrease the i.d. of bore 38 to a diameter corresponding to the o.d. of inner end 14 of the choke tube.

Figure 4A:
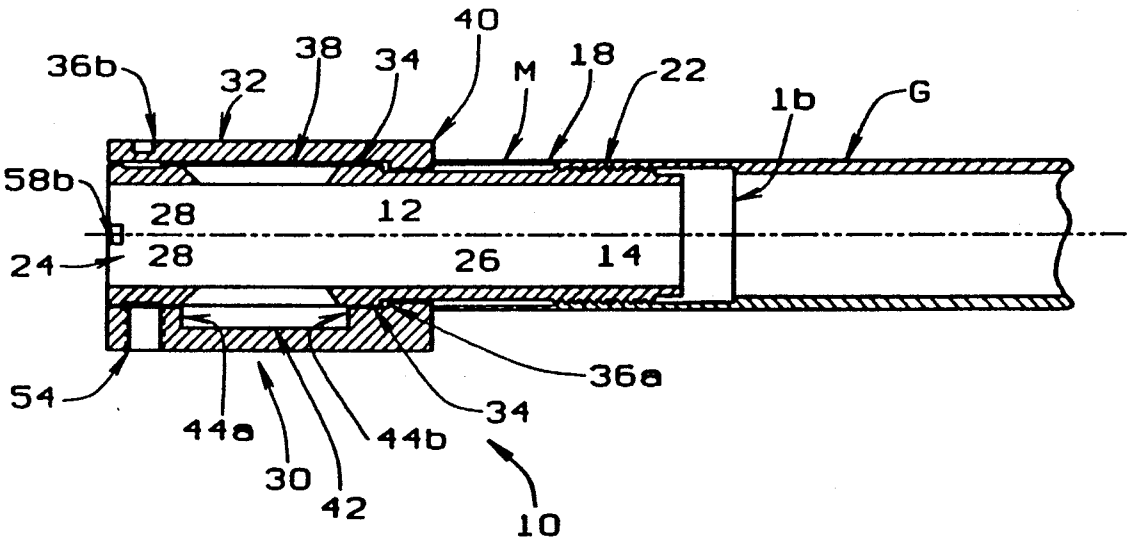
FIGS. 4A and 4B are respective sectional and end views of the apparatus installed on a shotgun.
Figure 4B:
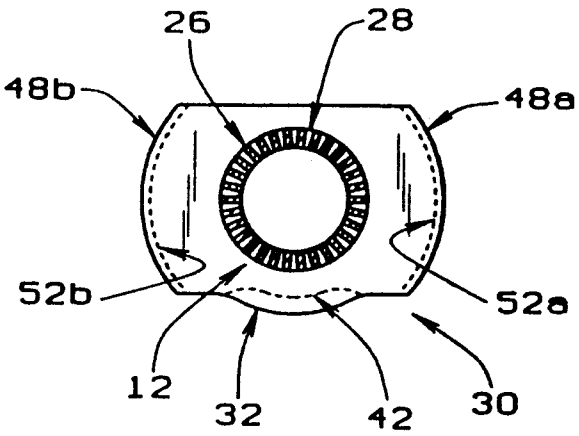
Figure 7:
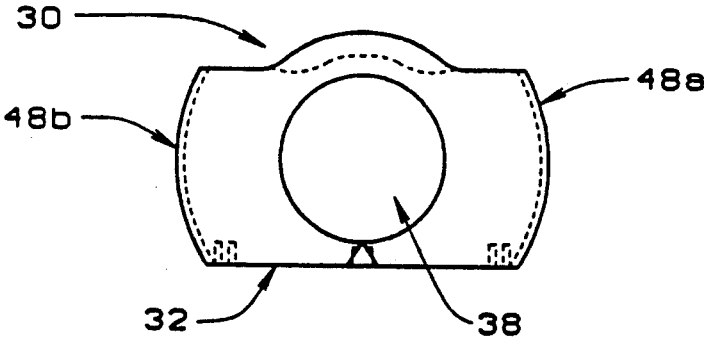
FIG. 7 is a front view of muzzle brake or recoil reducing portion of the assembly.
Figure 8:
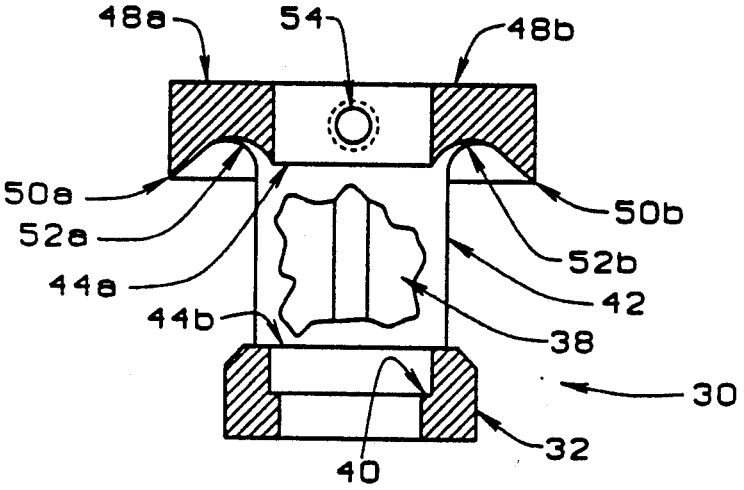
FIG. 8 is a bottom plan view, partially broken away, of the muzzle brake; and, FIGS. 9A and 9B are respective plan and elevational views of a tool for installing the apparatus.
Figure 9A:
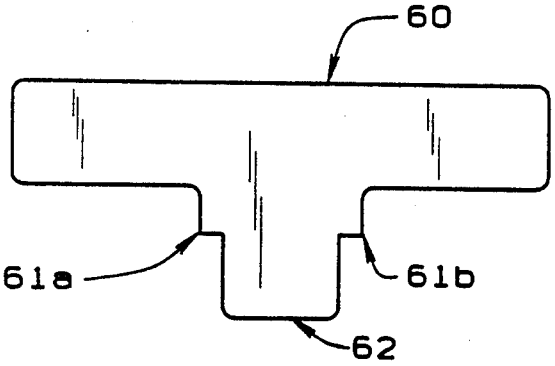
Figure 9B:
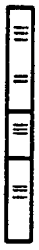

Next, the recoil reducer has an annular groove 42 extending partway around the circumference of tube 32. (See FIG. 4B.) Groove 42 has a length corresponding to that of the slots 28 and the groove is formed so its forward and rear walls 44*a*, 44*b* respectively register with the forward and rearward ends of the slots (see FIG. 4A). This means all the discharge gases escaping through the slots adjacent groove 42 escape into the groove. The gases then flow through the groove and into the atmosphere at the respective ends of the groove.

At the forward end of the recoil reducer, opposed gas deflectors 48*a*, 48*b* are formed. Each deflector comprises an outward extension formed on a respective side of the frontal portion of the reducer. The front face of each deflector corresponds with the front face of tube 32 so to be uniform across the front of the recoil reducer. The rearface 50*a*, 50*b* respectively has a groove or channel 52*a*, 52*b* respectively formed in it. The rear face is positioned adjacent the forward end of the slots 28 in the choke tube so gases escaping the choke tube blow into the channels. The outer end of each channel is curved rearwardly so gases blown into the channels are deflected rearwardly. This rearward deflection produces a counter-force pushing forward. This counter-force serves to further reduce the recoil force created when the shotgun is fired.

A screw hole 54 is formed in the bottom of the front portion of the recoil reducer. An allen screw 56, for example, fits in the screw hole, after the choke tube is installed in the recoil reducer to attach the two pieces firmly together. Typically, the screw is not tightened until the choke tube is threaded into the end of the barrel. Then, the recoil reducer is rotated until the deflectors 48*a*, 48*b* extend to the sides of the assembly. For installing the choke tube, the front end of the choke tube has opposed slots 58*a*, 58*b*. A wrench 60 has a center tab portion 62 the width of which corresponds to diameter D3 of the choke tube for the tab to fit into the outer end of the tube. To either side of the tab are shoulders 64*a*, 64*b* which respectively fit into slots 58*a*, 58*b*. A handle portion 66 of the whench is wide enough to allow the user to comfortably turn the wrench, even in the field, to thread the tube into, or out of, the muzzle.

What has been described is a choke for use on a shotgun to reduce the dispersion pattern of shot fired from the shotgun. The choke which is readily installed and removed from the muzzle end of a shotgun barrel using a simple tool. Also, the choke is designed to not be dislodged from the shotgun when shells having steel shot are fired from the gun. To accomodate the various sizes of shotguns, the choke is available in different sizes. A significant advantage of the choke design is that it effectively slows down or stops the spinning of wadding propelled through the barrel with the shot when the gun is fired. The apparatus also includes a recoil reduction attachment which acts to reduce the recoil force of the shotgun. The choke which is sturdy, portable, readily installed and removed in the field, easily stored at home, and is self-cleaning in that the discharge gases moving through the barrel force out any particles remaining in the barrel from a previously fired shell.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A choke assembly attachable to the muzzle of a shotgun barrel to produce a tightened pattern of shot when a shotgun shell is fired from the shotgun, the shotgun shell including a plurality of shot and a wadding which carries the shot as the shot is discharged down the barrel, the wadding spinning as it is propelled through the barrel by discharge gases created when the shell is fired, this spinning tending to increase the size of the shot pattern, the choke comprising:

an elongate hollow tube having an inner end receivable in the muzzle of the shotgun barrel with an outer diameter of the tube corresponding to the inner diameter of the muzzle, and an inner diameter of the tube corresponding to the inner diameter of the barrel, and an outer end of the tube extending beyond the muzzle, the inner diameter of the tube decreasing from the inner end to the outer end of the tube to effect a choke for the shotgun, and said outer end of said tube also having a plurality of slots formed therein, the slots extending longitudinally of the tube and spaced circumferentially thereabout, the discharge gases propelling the wadding through the barrel tending to force the wadding radially outwardly through the slots which slows the wadding and stops its spinning thereby to increase the tightness of the shot pattern, and a portion of the discharge gases also being expelled radially outwardly through the slots which reduces the recoil of the shotgun.

2. The choke assembly of claim 1 wherein the muzzle of the barrel has a greater inner diameter than the inner diameter of the barrel and the inner end of the tube has a corresponding outer diameter section allowing the inner end of the tube to fit into the muzzle of the barrel and maintain a constant inner diameter in the length of the entire barrel.

3. The choke assembly of claim 2 wherein the greater diameter section of the muzzle of the barrel is threaded, and the inner end of the tube is correspondingly threaded to attach the tube to the barrel.

4. The choke assembly of claim 3 further including means thereon for the insertion of a wrench means for installing the tube into the muzzle of the barrel.

5. The choke assembly of claim 4 wherein the outer end of the tube has diametrically opposed slots extending transversely of the tube, and the means for insertion of a wrench means includes a wrench fitting in said transverse slots to turn the tube and thread it into the muzzle end of the barrel.

6. The choke assembly of claim 1 further including recoil reducing means.

7. The choke assembly of claim 6 wherein the recoil reducing means includes a housing into which the tube is inserted prior to insertion of the inner end of the tube into the shotgun muzzle, said housing having a longitudinal bore sized to receive said tube and an annular channel formed in a sidewall of said housing adjacent the slots for gases expelled from the choke through the slots to flow into the channel.

8. The choke assembly of claim 7 wherein said housing further includes gas deflector means into which gas expelled from the choke through the slots are directed, the gas striking the deflector means being directed rearwardly which produces a corresponding forward force that, when combined with the force produced by the gases discharged through the outer end of the tube, serves to further reduce the recoil of the shotgun.

9. The choke assembly of claim 7 wherein said tube has circumferentially extending shoulder adjacent its inner end and the bore of said housing has a mating shoulder formed at the inner end of the housing, the respective shoulders abutting against each other when the tube is inserted through the housing to properly locate the tube in the housing.

10. The choke assembly of claim 8 wherein said housing has a cylindrical central bore, and the deflector means comprises opposed extensions extending outwardly from the front end of the housing.

11. The choke assembly of claim 10 wherein a forward face of each of the deflector extensions conforms with a front face of the housing, and a rear face of the extensions is in registry with the forward end of the slots formed in the tube for the gas expelled through the slots to impact the rear face of the extensions.

12. The choke assembly of claim 11 wherein the rear face of the extensions are concavely curved to form respective grooves into which the gases flow.

13. The choke assembly of claim 12 wherein the outer ends of the slots are longer than the inner ends thereof for the slots to angle outwardly from the inside to the outside of the tube thereby forming discharge paths for the gases, the angled forward ends of the slots shaving material off the ends of a wadding passing through tube to help slow the wadding and stop it spinning.

14. The choke assembly of claim 13 wherein the length of the channel corresponds to the length of the slots at the outer ends thereof.

15. The choke assembly of claim 14 wherein the housing has an opening extending around one-half thereof with the ends of the channel opening into this opening for gases expelled into the channel to flow into the opening.

16. A recoil reducing choke assembly attachable to the muzzle end of a shotgun barrel to produce a tightened pattern of shot when a shotgun shell is fired, the shotgun shell including a plurality of shot and a wadding which carries the shot as the shot is discharged down the barrel, the wadding spinning as it is propelled through the tube by discharge gases created when the shell is fired, this spinning tending to increase the size of the shot pattern, the assembly comprising;

an elongate hollow tube having an inner end received in the muzzle end of the shotgun barrel and an outer end which extends beyond the muzzle to effect a choke for the shotgun, said muzzle having an increase inner diameter section and the inner end of said tube having a correspondingly reduced outer diameter section for the inner end of said tube to fit into the barrel while maintaining a constant inner diameter for the barrel, and the outer end of said tube having a plurality of slots formed therein, said slots being evenly spaced about the circumference of said tube and extending longitudinally thereof, the discharge gases propelling the wadding through the barrel tending to force the wadding radially outwardly through the slots which slows the wadding and stops its spinning thereby to increase the tightness of the shot pattern, and a portion of the discharge gases also being expelled radially outwardly through the slots which reduces the recoil of the shotgun; and, a housing into which said tube is inserted prior to insertion into said shotgun barrel, said housing having a longitudinal bore sized to receive said tube and opposed extensions formed at the forward end of the housing and toward which gases expelled through the slots are directed, the gases striking a respective rear face of the extensions and being directed rearwardly, the force produced by the gases striking the extensions producing a force opposing the recoil force generated when the shotgun is discharged, thereby further reducing the recoil.

17. The assembly of claim 16 wherein the increased diameter section of the barrel is threaded, and the inner end of said tube is correspondingly threaded to attach the tube to the barrel, and the respective ends of said slots slope outwardly from an inner surface of said tube, the sloping ends of said slots, at a forward end thereof, shaving material off the wadding to help slow the wadding and stop its spinning.

18. The assembly of claim 17 wherein the outer end of the tube has diametrically opposed slots extending transversely of the tube to accommodate a wrench fitting in said transverse slots to turn the tube and thread it into the muzzle end of the barrel.

19. The assembly of claim 16 wherein the housing has a channel formed therein into which the gases expelled through a portion of the slots is directed, the slots being longer on the outer surface of the tube than on the inner surface thereof, the length of the channel corresponding to the length of the slots at the outer surface of the tube, and the ends of the channel being in registry with the ends of the slots so the gases expelled through the slots are expelled into the channel.

20. The assembly of claim 19 wherein the housing has an opening into which each end of the channel open for the gases expelled into the channel to blow into the opening, and a groove formed in the rear face of each extension to direct gases expelled through the slots rearwardly.

21. A choke attachable to the muzzle end of a shotgun barrel to produce a tightened pattern of shot when a shotgun shell is fired from the shotgun, the shotgun shell including a plurality of shot and wadding which carries the shot as the shot is discharged down the barrel, the wadding spinning as it is propelled through the barrel by discharge gases created when the shell is fired, this spinning tending to increase the size of show pattern, the choke comprising:

an elongate hollow tube having an inner end receivable in the muzzle of the shotgun barrel with an outer diameter of the tube corresponding to that of the muzzle, and an inner diameter corresponding to the inner diameter of the barrel, an outer end which extends beyond the muzzle, the inner diameter of the tube decreasing from the inner end to the outer end of the tube to effect a choke for the shotgun, and said outer end of said tube also having a plurality of slots formed therein, the slots extending longitudinally of the tube and spaced circumferentially thereabout, the respective ends of each slot sloping outwardly from an inner sidewall of said tube to an outer surface thereof, the discharge gases propelling the wadding through the barrel tending to force the wadding radially outwardly through the slots, the sloping surface at a forward end of each slots shaving off material from said wadding as said wadding as said wadding is forced outwardly through said slot, the forcing of the wadding into said slots, and the shaving of said wadding material at the forward end of said slots, slowing the wadding and stopping its spinning thereby to increase the tightness of the shot pattern.

* * * * *

UNITED STATES PATENT AND TRADEMARK OFFICE

CERTIFICATE OF CORRECTION

PATENT NO. : 5,317,825

DATED : June 7, 1994

INVENTOR(S) : Oskar F. Vatterott, et. al.

It is certified that error appears in the above-indentified patent and that said Letters Patent is hereby corrected as shown below:

Column 3, line 9, insert a period after "barrel";

Signed and Sealed this

Twenty-second Day of November, 1994

*Attest:*

*Attesting Officer*

Bruce Lehman

BRUCE LEHMAN

*Commissioner of Patents and Trademarks*